US005830109A

United States Patent [19]

Juarez

[11] Patent Number: 5,830,109

[45] Date of Patent: Nov. 3, 1998

[54] HAND EXERCISER AND STRESS RELIEVING DEVICE

[76] Inventor: Mark Reinle Juarez, 2141 W. 133rd Ave., San Leandro, Calif. 94577

[21] Appl. No.: 883,254

[22] Filed: Jun. 26, 1997

[51] Int. Cl.[6] ..... A63B 23/16

[52] U.S. Cl. ..... 482/44; 482/49

[58] Field of Search ..... 482/44, 49, 47; 446/391; 473/596, 614, 615, 569; 273/343

[56] References Cited

U.S. PATENT DOCUMENTS

| | | | |
|---|---|---|---|
| D. 226,736 | 4/1973 | Benis | 482/49 |
| D. 365,376 | 12/1995 | Bishop | D21/203 |
| 3,542,363 | 11/1970 | Bishop | 482/49 |
| 4,040,619 | 8/1977 | Landi | 272/68 |
| 4,222,560 | 9/1980 | Hallerman | 272/68 |
| 4,952,190 | 8/1990 | Tarnoff et al. | 446/267 |
| 5,180,171 | 1/1993 | Panzica et al. | 473/569 |
| 5,352,187 | 10/1994 | Tseng | 601/134 |
| 5,556,358 | 9/1996 | Scatterday | 482/49 |
| 5,580,335 | 12/1996 | Smith, IV | 482/44 |
| 5,580,336 | 12/1996 | Coallier | 482/44 |

*Primary Examiner*—Stephen R. Crow

*Attorney, Agent, or Firm*—Virginia H. Meyer, Esq.

[57] ABSTRACT

The present invention provides a new hand exerciser and stress relieving device that provides exercise to the muscles of the arm, wrist and hand of a user and a means for general stress relief. According to the invention, the hand exerciser and stress relieving device possess an overall digitate shape that easily adapts to the hand of a user and generally comprises a pliable outer cover and an inner malleable core that is non-elastic or has low elasticity. Also according to the teaching of the invention, the digitate shape of the device has a central region and a plurality of rounded pods that radially extend from the central region. The central region of the device is configured to lie comfortably in the palm of a user's hand. The rounded pods are configured to fit comfortably between the fingers of a user's hand as the user squeezes and kneads the device. This overall configuration achieves a novel hand exerciser and stress relieving device that provides gripping features for the user, as well as an easy and comfortable fit within the user's hand. Scented or aromatic materials, such as basil, cinnamon, clove, eucalyptus, juniper, lavender, lemon, lime, mint, orange, rose, rosemary, vanilla and the like may also be placed in the core of the device. As the user manipulates the device, a pleasing scent emanates from the device.

18 Claims, 3 Drawing Sheets

HAND EXERCISER AND STRESS RELIEVING DEVICE

BACKGROUND OF THE INVENTION

1. Field of the Invention

The present invention relates to a small exercising and stress relieving device that can be held in the user's hand, for providing exercise of the muscles of the arm, hand, and wrist, when the user flexes his or her fingers to squeeze and deform the device.

2. Description of the Prior Art

Many hand-held exercise and stress relief devices are known in the prior art. An example of such a prior art hand exercise device is a substantially spherical ball having a pliable outer coating and a flexible or pliable core material. To exercise the hand, the user simply squeezes the device with the fingers. This squeezing action may provide a form of stress relief for the user. Other prior art hand exercisers possess the same general spherical shape, but differ in materials. For example, one such hand exerciser comprises a flexible thick latex cover with a gel-like core. To exercise the hand, the user simply squeezes and manipulates the malleable device. Resistance to the user's hand flexing is provided by the viscous gel-like core.

While the hand exercisers and stress relief devices of the prior art fulfill their respective objectives and requirements, the prior art devices do not disclose or suggest a hand exerciser and stress relief device formed to have a digitate configuration with a central region and a plurality of extending pods. This configuration provides a hand exerciser and stress relieving device that easily adapts to the user's palm and fingers for enhanced gripping action. In this respect, the hand exerciser and stress relief device according to the present invention represents a substantial improvement over the concepts and designs of the prior art, and in doing so provides a novel hand exerciser and stress relief device primarily ergonomically developed for the purpose of easily adapting to the palm and fingers of a user and providing hand exercise and stress relief. Therefore, it can be appreciated that a need exists for a new hand exerciser and stress relief device that is inexpensive to manufacture and has a digitate configuration with a central region and a plurality of pods radially extending therefrom to easily adapt to the hand of the user providing an enhanced exercising and stress relieving effect. In this regard, the present invention substantially fulfills this need.

SUMMARY OF THE INVENTION

The present invention provides a new hand exerciser and stress relief device that provides exercise to the muscles of the arm, wrist and hand of a user and a means for general stress relief. According to the invention, the hand exerciser and stress relief device possesses an overall digitate shape that easily adapts to the hand of a user and generally comprises a pliable outer cover and an inner malleable, non-elastic or low elasticity core. Also according to the teaching of the invention, the digitate shape of the hand exerciser device has a central region and a plurality of rounded pods that radially extend from the central region. (As used herein, "plurality of rounded pods" means three or more rounded pods.) The central region of the device is configured to lie comfortably in the palm of a user's hand. The rounded pods are configured to fit comfortably between the fingers of a user's hand as the user squeezes and kneads the device. This overall configuration achieves a novel hand exercise and stress relief device that provides gripping features for the user, as well as an easy and comfortable fit within the user's hand. Scented or aromatic materials, such as basil, cinnamon, clove, eucalyptus, juniper, lavender, lemon, lime, mint, orange, rose, rosemary, vanilla and the like may also be placed in the core of the device. As the user manipulates the device, a pleasing scent emanates from the hand exercise device.

The pliable outer cover of the device is configured to provide the overall digitate shape having a plurality of pods that extend radially. More specifically, the outer cover may be made of any suitable material, including, but not limited to, cloth, latex, nylon, polyester, cotton, or any other pliable material. A preferred cover material is fleece, which is a synthetic material made from recycled plastic bottles; an example of such fleece is sold under the trademark ECO-SPUN™ by Dyersburg Fabrics, Inc., 1315 Philips Street, Dyersburg, Tenn. 30368; a most preferred cover material is a combination of fleece and polyester (approximately 87% fleece and 13% polyester). The outer cover may be of one-piece or two-piece construction. In one preferred embodiment having a four-pod configuration, the outer cover comprises two cruciate shaped halves that are joined together along their respective edges to form a pocket. The two halves are joined by any suitable means, including, but not limited to sewing, stitching, gluing and even heat lamination in the case of plastic-type outer covers.

In addition to the outer cover, the present invention includes a malleable inner core. The inner core is inelastic or has low-elasticity such that the device does not immediately flex back to its original shape when the user releases his or her grip. As used herein, "low elasticity", as it describes the inner core of the present invention, means the quality of slowly returning to an original state after deformation caused by the flexing of a user's hand. According to the present invention, an inner core of low elasticity provides a device that remains in a deformed state long enough to allow the user to knead the device with his or her hands. For example, a core of low elasticity would be one that substantially remains in a deformed state for at least about 15 seconds to allow the user to knead the device from the first deformed orientation to a new second orientation. Gel-like materials are an example of a core material with low elasticity. In preferred form, the inner core generally comprises a fill material, such as small Styrofoam balls, bean-bag-type filling, other types of small beaded filling, and/or natural materials such as rice, millet or flax seed. In other embodiments, the inner core may comprise an encapsulated viscous gel-like core that deflects as the user squeezes the device. Additionally, the inner core may also be filled with scented or aromatic materials, such as basil, cinnamon, clove, eucalyptus, juniper, lavender, lemon, lime, mint, orange, rose, rosemary and vanilla. In this embodiment, scent emanates from the device as the user exercises his or her hand and relieves stress.

The exact dimensions of the hand exercise and stress relieving device of the present invention may vary depending upon the hand size of the target user. According to the teaching of the invention, the dimensions of the central region and pods of the device are adapted to the hand of the target user. Specifically, the central region is sized such that the device rests comfortably in the user's palm, while the pods are configured such that they rest between the fingers allowing the user to grip around and manipulate them. To that end, the central region of the device may have a diameter ranging from about 1.5 inches to about 3 inches. The size of the pods may also vary from about 1 inch to about 2 inches in both length and width, and from about 0.75 to about 1.5 inches in thickness. By way of example, one preferred embodiment designed to fit an average-sized human hand has a central region of about 2 inches in diameter and pods of about 1.5 inches in length and width, and about 1 inch in thickness.

By way of example and in one preferred embodiment, the digitate configuration of the hand exercise device of the present invention comprises a central region and four rounded pods extending radially therefrom. In other preferred embodiments, the hand exerciser may possess three, or even five, rounded pods extending radially from the central region.

The more important features of the invention have thus been outlined, rather broadly, so that the detailed description thereof that follows may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

It is an object of the present invention to provide a hand exerciser and stress relief device that is ergonomically designed to fit comfortably in the human hand for enhanced and comfortable gripping and flexing thereof.

It is another object of the invention to provide a hand exerciser that will easily adapt to the user's hand.

It is an object of the present invention to provide a hand exerciser and stress relief device that will improve the fingers' dexterity and that will enhance muscular mass of the forearm, arm, wrist and hands, without inducing undue muscle strain or fatigue.

Corollary objects of the invention are that this hand exerciser be lightweight, simple in use, environmentally safe and of low manufacturing cost.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4(A and B) show the device in use by a user.

The same reference numerals refer to the same parts throughout the various Figures.

DESCRIPTION OF A FIRST PREFERRED EMBODIMENT

Figure 1:
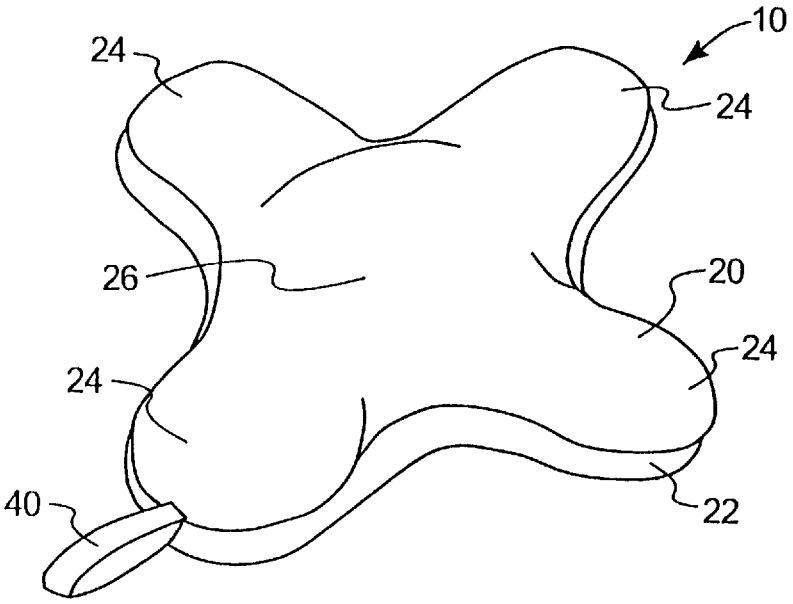
FIG. 1 is a perspective view of a first preferred embodiment constructed in accordance with the principles of the present invention.
Figure 2:
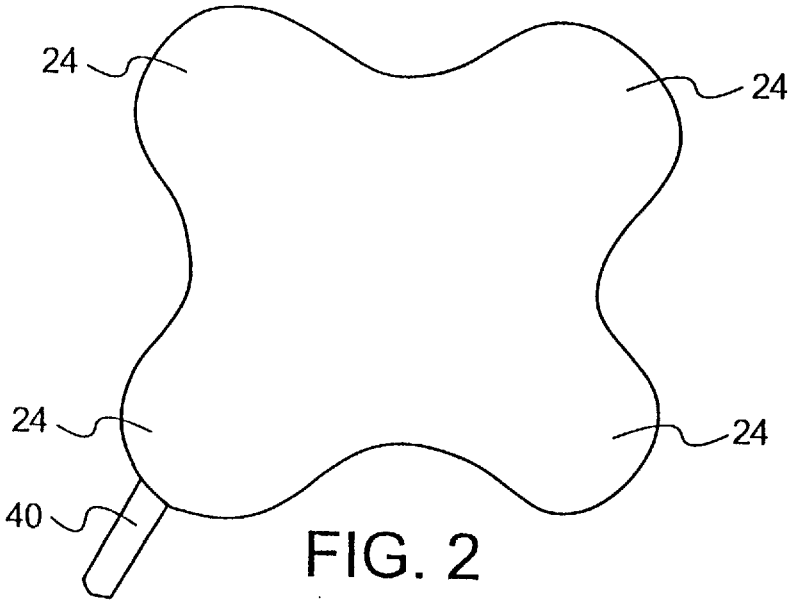
FIG. 2 is a sectional side elevation view of the first preferred embodiment of the present invention.
Figure 3:
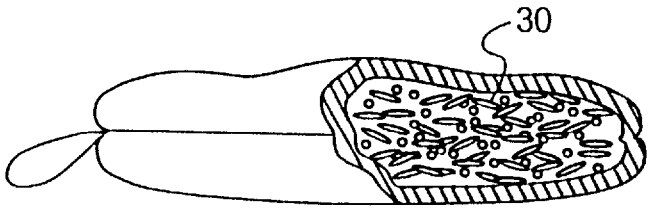
FIG. 3 is a top view of the first preferred embodiment of the present invention.

With reference now to the drawings, and in particular, to FIGS. 1–3 thereof, a first preferred embodiment of the new hand exercise and stress relief device embodying the principles and concepts of the present invention and generally designated by the reference number 10 will be described.

Specifically, it will be noted in the various Figures that the invention relates to a hand exercise and stress relief device that a user squeezes and kneads in the hand. In its broadest context, the invention comprises a hand-sized, digitate device having a pliable outer cover and a malleable inner core. Such components are individually configured and correlated with respect to each other so as to attain the desired objectives.

More specifically, in the first preferred embodiment the present invention is a device 10, as shown in FIGS. 1–3. System 10 comprises an outer cover, and an inner core. The outer cover 12 comprises an upper cover 20 and a lower cover 22. Upper cover 20 and lower cover 22 have a cruciate or star-like configuration having four rounded pods 24 that extend radially from a central region 26. In this embodiment, upper cover and lower cover are joined along their edges by conventional stitching methods to form a pocket receiving the inner core material 30. Further, central region 26 has a diameter of about 2 inches. The pods 24 of the first preferred embodiment are rounded having an overall width and length of about 1.5 inches and a thickness of about 1 inch.

Next, provided in device 10 is the inner core material 30. Inner core 30 comprises small spherical or ovoid objects, such as small plastic or Styrofoam beads, or a natural material such as rice, millet or flax seed. The inner core material 30 fills the pocket provided between upper and lower covers 20 and 22 to give the device 10 its cruciate shape. In other embodiments, inner core material 30 may also include scented or aromatic materials, such as basil, cinnamon, clove, eucalyptus, juniper, lavender, lemon, lime, mint, orange, rose, rosemary and vanilla that release from the device through the outer core material.

Device 10 may also include a finger loop 40 attached to the device by any suitable means. In this embodiment, finger loop 40 comprises an elastic material that is attached at the stitching that joins together upper cover 20 and lower cover 22.

Figure 4A:
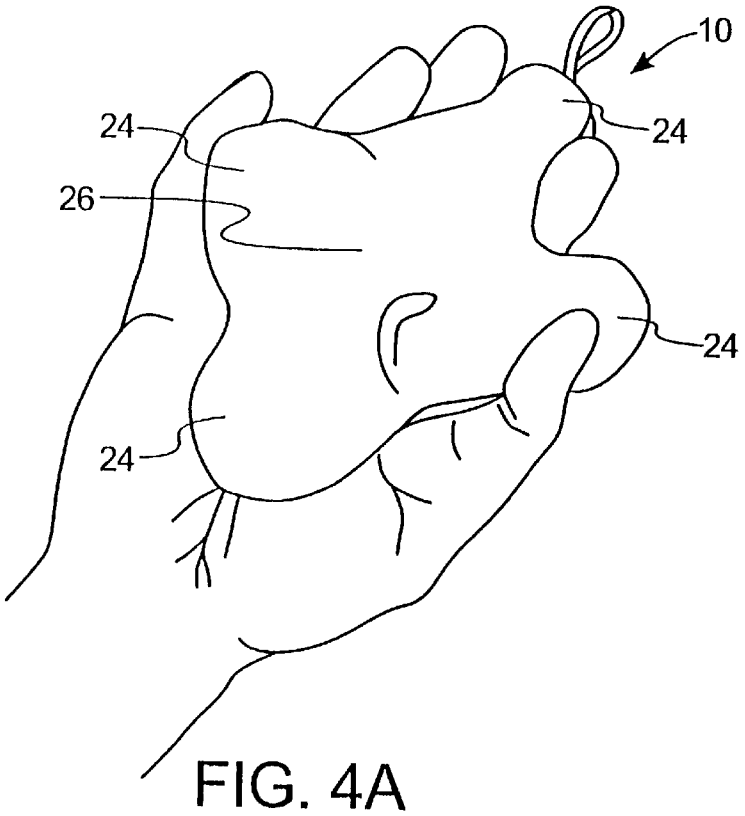
FIG. 4A is a perspective view of the device in the palm of the user's hand.
Figure 4B:
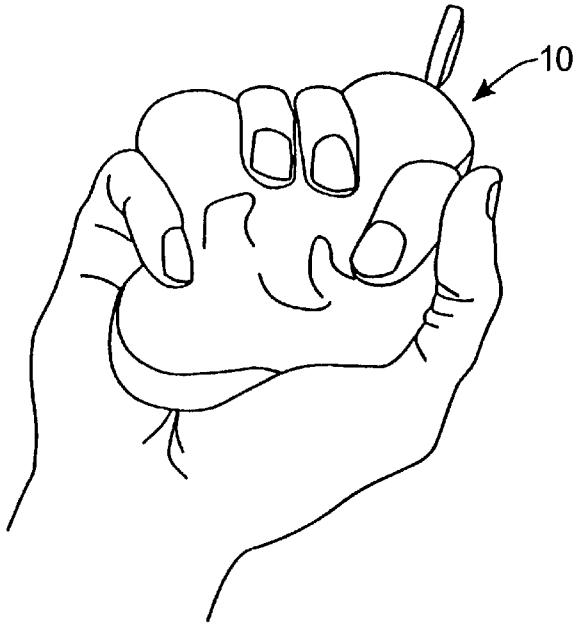
FIG. 4B is a perspective view of the device in use, with the user's fingers gripped around the device.

In actual use, the user holds hand exerciser device 10 in his or her hand with the central region 26 resting in the palm. As seen in FIGS. 4A and B, device 10 lies naturally in the hand of the user with pods 24 providing features that the user's digits may grip around and deform or knead.

DESCRIPTION OF OTHER PREFERRED EMBODIMENTS

Figure 5:
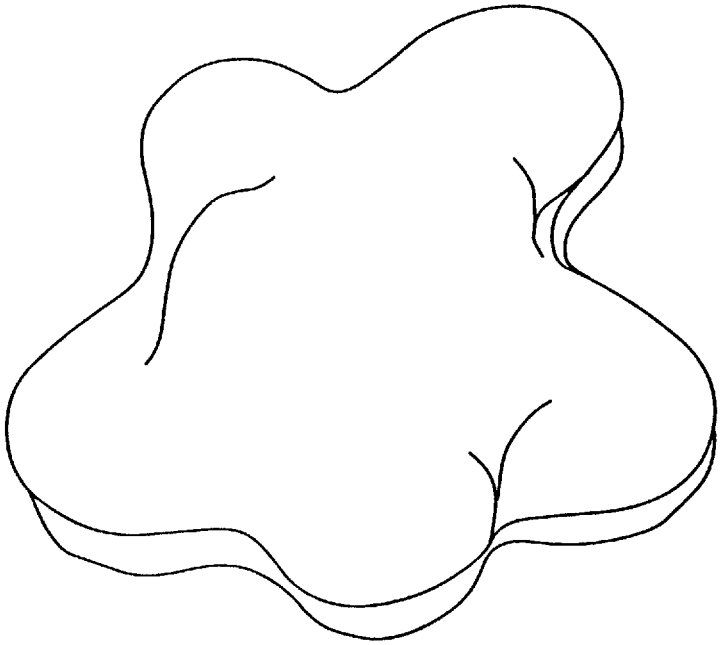
FIG. 5 is a perspective view of a second preferred embodiment constructed in accordance with the principles of the present invention.
Figure 6:
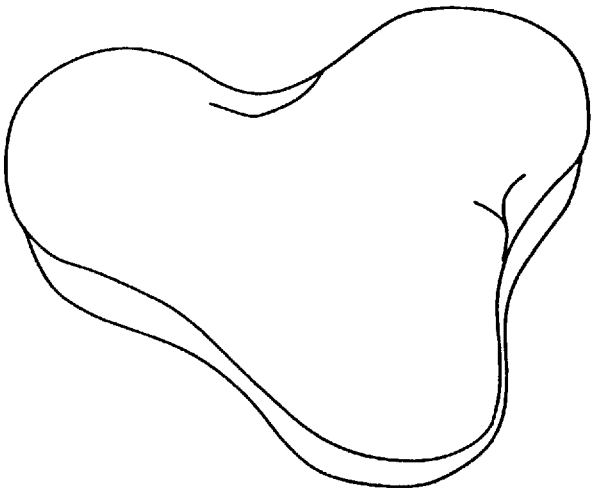
FIG. 6 is a perspective view of a third preferred embodiment constructed in accordance with the principles of the present invention.

FIGS. 5 and 6 disclose second and third preferred embodiments, respectively. As shown in FIG. 5, the second preferred embodiment features a hand exercise and stress relieving device having a 3-pod configuration. Similarly, as shown in FIG. 6, the third preferred embodiment features a 5-pod configuration. Otherwise, the construction and use of the second and third preferred embodiments are substantially the same as the first preferred embodiment. Accordingly, reference should be had to the description of the first preferred embodiment, as such description will not be repeated herein.

SUMMARY

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents which may be resorted to fall within the scope of the invention.

What is claimed as being new and desired to be protected by Letters Patent of the United States is as follows:

1. A hand exerciser and stress relieving device comprising:

a pliable outer cover;

an inner malleable core that is non-elastic or has low elasticity;

wherein said device has an overall digitate configuration having a central region and at least three rounded pods extending radially from said central region;

wherein the central region has a diameter ranging from about 1.5 inches to about 3 inches and rests comfortably within the palm of a user's hand; and, wherein said pods range in size from about 1 inch to about 2 inches in both length and width, and from about 0.75 to about 1.5 inches in thickness, and are configured to fit comfortably between the fingers of a user's hand as the user squeezes and kneads the device.

2. The device of claim 1 wherein said device has three rounded pods extending radially from said central region.

3. The device of claim 1 wherein said device has four rounded pods extending radially from said central region.

4. The device of claim 1 wherein said device has five rounded pods extending radially from said central region.

5. The device according to claim 1 wherein the pliable outer cover comprises a first cover and a second cover that are joined along their common edges.

6. A hand exerciser and stress relieving device according to claim 1 wherein said pliable covers are comprised of cloth, latex, nylon, polyester, cotton, fleece, or ECO-SPUN™, or any combination thereof.

7. The device according to claim 1 further including a finger loop attached thereto.

8. The device according to claim 1 wherein the inner malleable core comprises small bead-like or ovoid objects.

9. The device according to claim 1 wherein the inner malleable core comprises at least one of the following: rice, millet or flax seed.

10. The device according to claim 1 wherein the inner malleable core comprises an encapsulated viscous gel.

11. The device according to claim 1 wherein the inner core further comprises at least one aromatic substance.

12. The device according to claim 11 wherein said aromatic substance is selected from the group consisting of basil, cinnamon, clove, eucalyptus, juniper, lavender, lemon, lime, mint, orange, rose, rosemary and vanilla.

13. A hand exerciser and stress relieving device comprising:

a first pliable outer cover and a second pliable outer cover;

wherein said first outer cover is joined to said second outer cover along their common outer edges to form a pocket;

an inner malleable core that is non-elastic or has low elasticity;

wherein said inner malleable core lies within said pocket between said first and second covers;

wherein said device has an overall digitate shape having a central region and a plurality of rounded pods extending radially from said central region;

wherein said central region has a diameter ranging from about 1.5 inches to about 3 inches and rests comfortably within the palm of a user's hand; and, wherein said pods are from about 1 inch to about 2 inches in both length and width, and from about 0.75 to about 1.5 inches in thickness, and are configured to fit comfortably between the fingers of a user's hand as the user squeezes and kneads the device.

14. A hand exerciser and stress relieving device comprising:

a first pliable outer cover and a second pliable outer cover;

wherein said first outer cover is joined to said second outer cover along their common outer edges to form a pocket;

an inner malleable, non-elastic core comprised of at least one of the following substances: rice, millet, flax seed, beads, styrofoam balls, bean-bag type filling;

wherein said inner malleable core lies within said pocket between said first and second covers;

wherein said device has an overall digitate shape having a central region and a plurality of rounded pods extending radially from said central region;

wherein said central region has a diameter ranging from about 1.5 inches to about 3 inches and rests comfortably within the palm of a user's hand; and, wherein said pods are from about 1 inch to about 2 inches in both length and width, and from about 0.75 to about 1.5 inches in thickness, and are configured to fit comfortably between the fingers of a user's hand as the user squeezes and kneads the device.

15. A hand exerciser and stress relieving device according to claim 14 wherein said pliable covers are comprised of cloth, latex, nylon, polyester, cotton, fleece, ECO-SPUN™, or any combination thereof.

16. A hand exerciser and stress relieving device according to claim 14 wherein said inner malleable, non-elastic core further comprises at least one aromatic substance.

17. The device according to claim 16 wherein said aromatic substance(s) are selected from the group consisting of basil, cinnamon, clove, eucalyptus, juniper, lavender, lemon, lime, mint, orange, rose, rosemary and vanilla.

18. A hand exerciser and stress relieving device comprising:

a pliable outer cover;

an inner malleable core that is non-elastic or has low elasticity;

wherein said device has an overall cruciate shape having a central region and four rounded pods extending radially from said central region;

wherein the central region has a diameter ranging from about 1.5 inches to about 3 inches and rests comfortably within the palm of a user's hand; and, wherein said pods are from about 1 inch to about 2 inches in both length and width, and from about 0.75 to about 1.5 inches in thickness, and are configured to fit comfortably between the fingers of a user's hand as the user squeezes and kneads the device.

* * * * *

UNITED STATES PATENT AND TRADEMARK OFFICE

CERTIFICATE OF CORRECTION

PATENT NO. : 5,830,109

DATED : November 3, 1998

INVENTOR(S) : Mark Reinle Juarez

It is certified that error appears in the above-indentified patent and that said Letters Patent is hereby corrected as shown below:

Col. 1, lines 51, 54 and 67; at page 3, lines 41 and 47; and at page 4, lines 28 and 32, "relief" should read —relieving—.

Col. 3, line 62, delete "in".

Col. 4, lines 7 and 8, "FIG. 2 is a sectional side elevation view of the first preferred embodiment of the present invention." should read —FIG. 2 is a top view of the first preferred embodiment of the present invention.—

Col. 4, lines 9 and 10, "FIG. 3 is a top view of the first preferred embodiment of the present invention." should read —FIG. 3 is a sectional side elevation view of the first preferred embodiment of the present invention.—

Col. 4, line 46, "upper cover and lower cover" should read —upper cover 20 and lower cover 22—.

Col. 4, line 53, "Inner core 30" should read —Inner core material 30—.

Col. 5, line 12, "3-pod" should read —5-pod—.

UNITED STATES PATENT AND TRADEMARK OFFICE

CERTIFICATE OF CORRECTION

PATENT NO. : 5,830,109

DATED : November 3, 1998

INVENTOR(S) : Mark Reinle Juarez

It is certified that error appears in the above-identified patent and that said Letters Patent is hereby corrected as shown below:

Col. 5, line 14, "5-pod" should read --3-pod--.

Signed and Sealed this

Sixth Day of April, 1999

*Attest:*

*Attesting Officer*

Q. TODD DICKINSON

*Acting Commissioner of Patents and Trademarks*